US011854480B2

(12) United States Patent
Yu et al.

(10) Patent No.: US 11,854,480 B2
(45) Date of Patent: Dec. 26, 2023

(54) PIXEL CIRCUIT, METHOD FOR DRIVING PIXEL CIRCUIT AND DISPLAY DEVICE

(71) Applicant: LG DISPLAY CO., LTD., Seoul (KR)

(72) Inventors: Jae Sung Yu, Paju-si (KR); Jae Hoon Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/847,988

(22) Filed: Jun. 23, 2022

(65) Prior Publication Data

US 2023/0010040 A1 Jan. 12, 2023

(30) Foreign Application Priority Data

Jul. 8, 2021 (KR) ..... 10-2021-0089629

(51) Int. Cl.
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2300/043* (2013.01); *G09G 2300/0426* (2013.01); *G09G 2300/0819* (2013.01); *G09G 2300/0842* (2013.01); *G09G 2320/0233* (2013.01); *G09G 2320/0238* (2013.01)

(58) Field of Classification Search
CPC ..... G09G 3/3233; G09G 3/2007; G09G 2300/0426; G09G 2300/043; G09G 2300/0842; G09G 2320/0233; G09G 2320/0238; G09G 2300/0852; G09G 2300/0861; G09G 2310/0262; G09G 2320/045
See application file for complete search history.

(56) References Cited

U.S. PATENT DOCUMENTS

2013/0063413 A1* 3/2013 Miyake ..... G09G 3/32 345/212
2015/0155345 A1* 6/2015 Miyake ..... G09G 3/32 257/40
2016/0042694 A1* 2/2016 Lim ..... G09G 3/3233 345/78
2016/0329392 A1* 11/2016 Miyake ..... H01L 27/1255
(Continued)

FOREIGN PATENT DOCUMENTS

KR 10-2006-0083101 A 7/2006
KR 10-2019-0072200 A 6/2019
KR 10-2020-0071433 A 6/2020

*Primary Examiner* — Jeff Piziali
(74) *Attorney, Agent, or Firm* — Morgan, Lewis & Bockius LLP

(57) ABSTRACT

A pixel circuit, a method for driving a pixel circuit and a display device. The pixel circuit includes a driving element including a first electrode connected to a first node, a first gate electrode connected to a second node, a second electrode connected to a third node, and a second gate electrode to which a preset voltage is applied; a light emitting element including an anode electrode connected to a fourth node and a cathode electrode to which a low-potential power supply voltage is applied, the light emitting element being driven according to a current from the driving element; a first switch element connected between the first node and the second node; and a second switch element connected between the third node and the fourth node.

14 Claims, 10 Drawing Sheets

(56) References Cited

U.S. PATENT DOCUMENTS

| | | | | |
|---|---|---|---|---|
| 2020/0051506 | A1* | 2/2020 | Yang | H10K 59/1213 |
| 2020/0194471 | A1* | 6/2020 | Miyake | G09G 3/3233 |
| 2021/0013235 | A1* | 1/2021 | Toda | G02F 1/1368 |
| 2022/0366849 | A1* | 11/2022 | Lee | G09G 3/3233 |

* cited by examiner

PIXEL CIRCUIT, METHOD FOR DRIVING PIXEL CIRCUIT AND DISPLAY DEVICE

CROSS-REFERENCE TO RELATED APPLICATION

This application claims priority to and the benefit of Korean Patent Application No. 10-2021-0089629, filed Jul. 8, 2021, the disclosure of which is incorporated herein by reference in its entirety.

BACKGROUND

1. Technical Field

The present disclosure relates to a pixel circuit, a method for driving a pixel circuit and a display device.

2. Discussion of the Related Art

Electroluminescent display devices are roughly classified into inorganic light emitting display devices and organic light emitting display devices depending on the material of the emission layer. The organic light emitting display device of an active matrix type includes an organic light emitting diode (hereinafter, referred to as "OLED") that emits light by itself, and has an advantage in that the response speed is fast and the luminous efficiency, luminance, and viewing angle are large. In the organic light emitting display device, the OLED is formed in each pixel. The organic light emitting display device not only has a fast response speed, excellent luminous efficiency, luminance, and viewing angle, but also has excellent contrast ratio and color reproducibility since it can express black gray scales in complete black.

A pixel circuit of the electroluminescent display device includes the OLED used as a light emitting element and a driving element for driving the OLED. Electrical characteristics of the driving element may be changed due to deterioration of the driving element. In this case, because the quality of an image reproduced on a screen is lowered, it is necessary to compensate for the electrical characteristics of the driving element. In particular, when a threshold voltage of the driving element is shifted, it is difficult to sense the threshold voltage of the driving element when a shift range exceeds a voltage capable of sensing.

For example, in case that the driving element is implemented as a transistor including an oxide semiconductor, if the threshold voltage of the transistor is near 0V, it is difficult to compensate for the shift in the threshold voltage of the driving element.

When a driving frequency of the display device increases or a resolution of the display device increases, one horizontal period becomes smaller. In this case, compensation performance is deteriorated because the time for sensing and sampling the threshold voltage of the driving element is insufficient, thus making it difficult to implement the luminance of black gray scales.

SUMMARY

Accordingly, embodiments of the present disclosure are directed to a pixel circuit, a method for driving a pixel circuit and a display device that substantially obviate one or more of the problems due to limitations and disadvantages of the related art.

Aspects of the present disclosure solve the above-mentioned needs and/or problems. An aspect of the present disclosure is to provide a pixel circuit capable of accurately sampling a threshold voltage of a driving element, and also provides a method for driving a pixel circuit and a display device.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a pixel circuit comprises a driving element including a first electrode connected to a first node, a first gate electrode connected to a second node, a second electrode connected to a third node, and a second gate electrode to which a preset voltage is applied; a light emitting element including an anode electrode connected to a fourth node and a cathode electrode to which a low-potential power supply voltage is applied, the light emitting element being driven according to a current from the driving element; a first switch element connected between the first node and the second node; and a second switch element connected between the third node and the fourth node.

In another aspect, a method for driving a pixel circuit including a light emitting element and a driving element having a first electrode, a second electrode, a first gate electrode, and a second gate electrode comprises an initialization step of applying an initialization voltage to the first gate electrode of the driving element through an anode electrode of the light emitting element and a first capacitor, and applying a pixel driving voltage higher than the initialization voltage to the first electrode of the driving element; a sampling step of applying a reference voltage lower than the pixel driving voltage to the second electrode of the driving element and to the first electrode of the driving element through a second capacitor; an addressing step of applying a data voltage of pixel data to the first electrode of the driving element through the second capacitor; and a light emission step of forming a current path between a power line to which the pixel driving voltage is applied and the light emitting element, and cutting off the initialization voltage and the reference voltage applied to the driving element and the light emitting element.

The initialization voltage is applied to the second gate electrode of the driving element in the initialization step, the sampling step, and the addressing step.

In another expect, a display device comprises the pixel circuit. For example, the display device comprises: a display panel in which a plurality of data lines, a plurality of gate lines intersected with the data lines, a first power line to which a pixel driving voltage is applied, a second power line to which an initialization voltage is applied, a third power line to which a reference voltage is applied, a fourth power line to which a low-potential power supply voltage is applied, and a plurality of pixel circuits connected to the data lines, the gate lines, and the power lines are disposed; a data driver supplying a data voltage of pixel data to the data lines; and a gate driver supplying a gate signal to the gate lines, wherein each of the pixel circuits includes: a driving element including a first electrode connected to a first node, a first gate electrode connected to a second node, a second electrode connected to a third node, and a second gate electrode to which a preset voltage is applied; a light emitting element including an anode electrode connected to a fourth node and a cathode electrode to which a low-potential power supply voltage is applied, the light emitting element being driven according to a current from the driving element; a first switch element connected between the first node and the second node; and a second switch element connected between the third node and the fourth node.

The present disclosure can shift the threshold voltage of the driving element to a voltage range capable of sensing by means of a voltage applied between the second gate electrode and the source electrode of the driving element by applying a preset voltage, e.g., an initialization voltage, to the second gate electrode of the driving element in an internal compensation circuit of a diode connection scheme. As a result, by shifting the threshold voltage of the driving element shifted to a voltage of 0 V or less to a voltage capable of sensing, the present disclosure can sense the threshold voltage of the driving element and compensate for the threshold voltage of the driving element.

The present disclosure can reduce power consumption by using an oxide TFT whose threshold voltage is shifted to a voltage of 0 V or less as the driving element of the pixel circuit, improve the reliability of the display panel, and ensure the reliability of the elements constituting the pixel circuit.

By separating the sampling step and the addressing step in the pixel circuit to which the internal compensation circuit is applied, the present disclosure can ensure a sufficient time required for sampling the threshold voltage of the driving element, solve the problems of realization of black luminance and deterioration of compensation performance, allow high-speed driving of the display device, and improve the image quality in high-resolution and high-speed driving display device.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
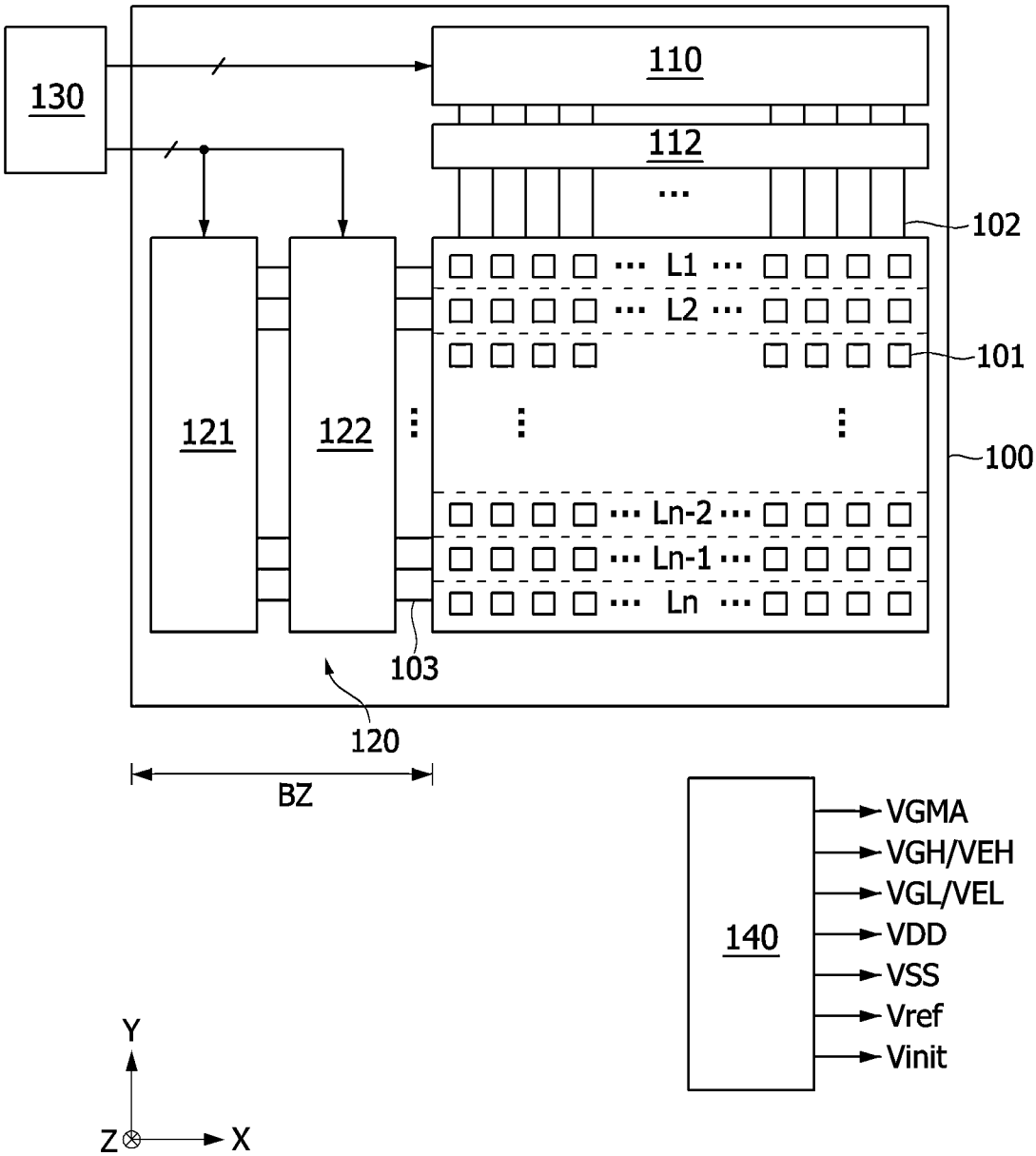
FIG. 1 is a block diagram illustrating a display device according to one embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," "having," and "consist of" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The same reference numerals may refer to substantially the same elements throughout the present disclosure.

The following embodiments can be partially or entirely bonded to or combined with each other and can be linked and operated in technically various ways. The embodiments can be carried out independently of or in association with each other.

Each of the pixels may include a plurality of sub-pixels having different colors to in order to reproduce the color of the image on a screen of the display panel. Each of the sub-pixels includes a transistor used as a switch element or a driving element. Such a transistor may be implemented as a TFT (Thin Film Transistor).

A driving circuit of the display device writes a pixel data of an input image to pixels on the display panel. To this end, the driving circuit of the display device may include a data driving circuit configured to supply data signal to the data lines, a gate driving circuit configured to supply a gate signal to the gate lines, and the like.

In a display device of the present disclosure, the pixel circuit and the gate driving circuit may include a plurality of transistors. Transistors may be implemented as oxide thin film transistors (oxide TFTs) including an oxide semiconductor, low temperature polysilicon (LTPS) TFTs including low temperature polysilicon, or the like. In embodiments, descriptions will be given based on an example in which the transistors of the pixel circuit and the gate driving circuit are implemented as the n-channel oxide TFTs, but the present disclosure is not limited thereto.

Generally, a transistor is a three-electrode element including a gate, a source, and a drain. The source is an electrode that supplies carriers to the transistor. In the transistor, carriers start to flow from the source. The drain is an electrode through which carriers exit from the transistor. In a transistor, carriers flow from a source to a drain. In the case of an n-channel transistor, since carriers are electrons, a source voltage is a voltage lower than a drain voltage such that electrons may flow from a source to a drain. The n-channel transistor has a direction of a current flowing from the drain to the source. In the case of a p-channel transistor (p-channel metal-oxide semiconductor (PMOS), since carriers are holes, a source voltage is higher than a drain voltage such that holes may flow from a source to a drain. In the p-channel transistor, since holes flow from the source to the drain, a current flows from the source to the drain. It should be noted that a source and a drain of a transistor are not fixed. For example, a source and a drain may be changed according to an applied voltage. Therefore, the disclosure is not limited due to a source and a drain of a transistor. In the following description, a source and a drain of a transistor will be referred to as a first electrode and a second electrode.

A gate signal swings between a gate-on voltage and a gate-off voltage. The gate-on voltage is set to a voltage higher than a threshold voltage of a transistor, and the gate-off voltage is set to a voltage lower than the threshold voltage of the transistor.

The transistor is turned on in response to the gate-on voltage and is turned off in response to the gate-off voltage. In the case of an n-channel transistor, a gate-on voltage may be a gate high voltage VGH and VEH, and a gate-off voltage may be a gate low voltage VGL and VEL.

Hereinafter, various embodiments of the present disclosure will be described in detail with reference to the accompanying drawings. In the following embodiments, a display device will be described focusing on an organic light emitting display device, but the present disclosure is not limited thereto.

Referring to FIG. 1, a display device according to an embodiment of the present disclosure includes a display panel 100, a display panel driver for writing pixel data to pixels of the display panel 100, and a power supply 140 for generating power necessary for driving the pixels and the display panel driver.

Figure 5:
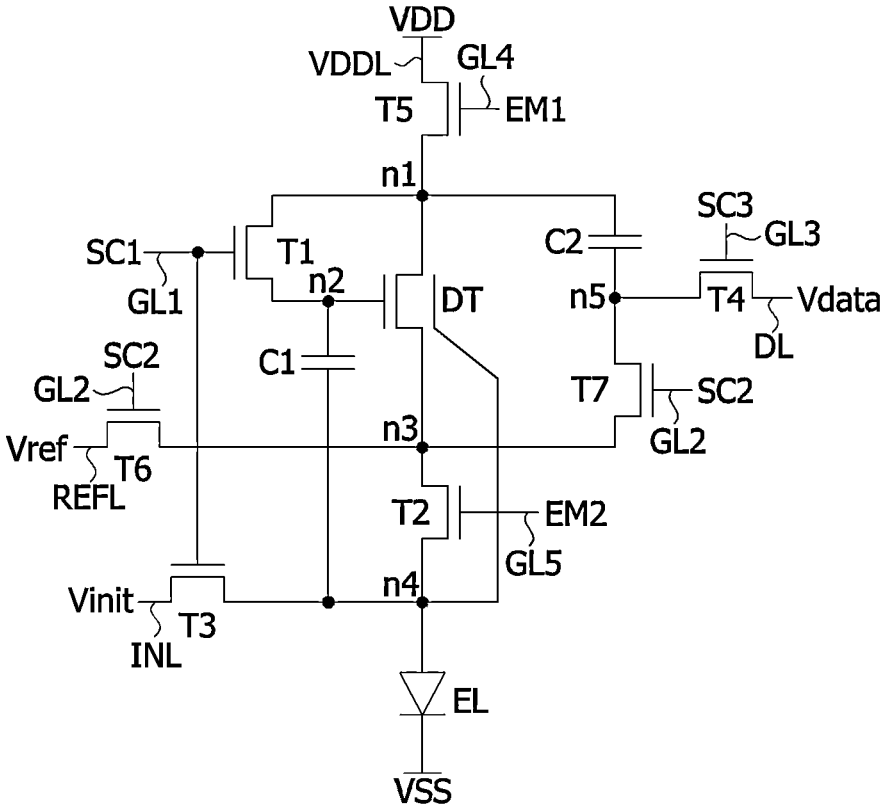
FIG. 5 is a circuit diagram illustrating a pixel circuit according to another embodiment of the present disclosure.

The display panel 100 may be a display panel of a rectangular structure having a length in the X-axis direction, a width in the Y-axis direction, and a thickness in the Z-axis direction. The display panel 100 includes a pixel array that displays an input image on a screen. The pixel array includes a plurality of data lines 102, a plurality of gate lines 103 intersected with the data lines 102, and pixels arranged in a matrix form. The display panel 100 may further include power lines commonly connected to the pixels. In FIG. 5, the power lines may include a first power line VDDL to which a pixel driving voltage VDD is applied, a second power line INL to which an initialization voltage Vinit is applied, and a third power line REFL to which a reference voltage Vref is applied. The display panel 100 may further include a fourth power line to which a low-potential power supply voltage VSS is applied.

The pixel array includes a plurality of pixel lines L1 to Ln. Each of the pixel lines L1 to Ln includes one line of pixels arranged along a line direction X in the pixel array of the display panel 100. Pixels arranged in one pixel line share the same gate lines 103. Sub-pixels arranged in a column direction Y along a data line direction share the same data line 102. One horizontal period 1H is a time obtained by dividing one frame period by the total number of pixel lines L1 to Ln.

The display panel 100 may be implemented as a non-transmissive display panel or a transmissive display panel. The transmissive display panel may be applied to a transparent display device in which an image is displayed on a screen and an actual background is visible.

The display panel may be manufactured as a flexible display panel. The flexible display panel may be implemented as an OLED panel using a plastic substrate. A pixel array and a light emitting element may be disposed on an organic thin film adhered to a back plate of the plastic OLED panel.

The organic thin film may be disposed on the back plate of the plastic OLED panel. A pixel circuit and a light emitting element may be stacked on the organic thin film, and a touch sensor array may be formed thereon. The back plate blocks the moisture permeation towards the organic thin film so that the pixel array is not exposed to humidity. The organic thin film may be a thin Polyimide (PI) film substrate. A multi-layered buffer film of an insulating material (not shown) may be formed on the organic thin film. Lines of the pixel array may be formed on the organic thin film so as to supply power or signals applied to the pixel circuit and the touch sensor array.

Each of the pixels 101 may be divided into a red sub-pixel, a green sub-pixel, and a blue sub-pixel to implement color. Each of the pixels may further include a white sub-pixel. Each of the sub-pixels includes a pixel circuit. Hereinafter, a pixel may be interpreted as having the same meaning as a sub-pixel. Each pixel circuit is connected to the data lines, the gate lines, and the power lines.

The pixels may be arranged as real color pixels and pentile pixels. The pentile pixel may realize a higher resolution than the real color pixel by driving two sub-pixels having different colors as one pixel 101 through a preset pixel rendering algorithm. The pixel rendering algorithm may compensate for insufficient color representation in each pixel with the color of light emitted from an adjacent pixel.

A circuit layer of the display panel 100 may include a TFT array including a pixel circuit connected to wires such as a data line, a gate line, a power line, and the like, a demultiplexer array 112, a gate driver 120 and the like. The wire and circuit elements of the circuit layer may include a plurality of insulating layers, two or more metal layers separated with the insulating layer therebetween, and an active layer including a semiconductor material. All transistors formed in the circuit layer 12 may be implemented as n-channel oxide TFTs.

Touch sensors may be disposed on the display panel 100. A touch input may be sensed using separate touch sensors or may be sensed through pixels. The touch sensors may be disposed as an on-cell type or an add-on type on the screen of the display panel or implemented as in-cell type touch sensors embedded in the pixel array.

The power supply 140 generates DC power required for driving the pixel array and the display panel driver of the display panel 100 by using a DC-DC converter. The DC-DC converter may include a charge pump, a regulator, a buck converter, a boost converter, and the like. The power supply 140 may adjust the level of a DC input voltage applied from a host system (not shown) and thereby generate DC voltages such as a gamma reference voltage VGMA, gate-on voltages VGH and VEH, gate-off voltages VGL and VEL, pixel driving voltage VDD, a low-potential power supply voltage VSS, a reference voltage Vref, and an initialization voltage Vinit. The gamma reference voltage VGMA is supplied to a data driver 110. The gate-on voltages VGH and VEH and the gate-off voltages VGL and VEL are supplied to a gate driver 120. The pixel driving voltage VDD, the low-potential power supply voltage VSS, the reference voltage Vref, and the initialization voltage Vinit are commonly supplied to the pixels. The reference voltage Vref and the initialization voltage Vinit may be generated from the data driver 110.

The display panel driver writes pixel data of an input image to the pixels of the display panel 100 under the control of a timing controller (TCON) 130.

The display panel driver includes the data driver 110 and the gate driver 120. The display panel driver may further include a de-multiplexer array 112 disposed between the data driver 110 and the data lines 102.

The de-multiplexer array 112 sequentially connects channels of the data driver 110 to the data lines 102 by using a plurality of de-multiplexers (DEMUX) to transfer the data voltage output from the data driver 110 to the data lines 102. The de-multiplexer array 112 may include a plurality of switch elements disposed on the display panel 100. When the de-multiplexer array 112 is disposed between output terminals of the data driver 110 and the data lines 102, the number of channels of the data driver 110 may be reduced. The de-multiplexer array 112 may be omitted.

The display panel driver may further include a touch sensor driver for driving the touch sensors. The touch sensor driver is omitted from FIG. 1. The data driver and the touch sensor driver may be integrated into one drive integrated circuit (IC). In a mobile device or a wearable device, the timing controller 130, the power supply 140, the data driver 110, and the like may be integrated into one drive IC.

The display panel driver may operate in a low-speed driving mode under the control of the timing controller 130. The low-speed driving mode may be set to reduce power consumption of the display device when the input image does not change by a preset number of frames under analysis of the input image. In the low-speed driving mode, the power consumption of the display panel driver and the display panel 100 may be reduced by lowering a refresh rate of the pixels when still images are inputted for a predetermined time or more. The low-speed driving mode is not limited to a case where still images are inputted. For example, when the display device operates in a standby mode or when a user command or an input image is not inputted to a display panel driving circuit for a predetermined time or more, a display panel driving circuit may operate in the low-speed driving mode.

The data driver 110 generates a data voltage by converting pixel data of an input image received as a digital signal from the timing controller 130 with a gamma compensation voltage every frame period by using a digital to analog converter (DAC). The gamma reference voltage VGMA is divided into gamma compensation voltages for respective gray scales through a voltage divider circuit. The gamma compensation voltage for each gray scale is provided to the DAC of the data driver 110. The data voltage is outputted through an output buffer in each of the channels of the data driver 110.

The gate driver 120 may be implemented as a gate in panel (GIP) circuit directly formed on the display panel 100 together with a TFT array and wirings of the pixel array. The GIP circuit may be disposed in a bezel (BZ) area, which is a non-display area, of the display panel 100 or may be dispersedly disposed in the pixel array in which an input image is reproduced. The gate driver 120 sequentially outputs gate signals to the gate lines 103 under the control of the timing controller 130. The gate driver 120 may sequentially supply the gate signals to the gate lines 103 by shifting the gate signals using a shift register. The gate signal may include a scan signal and a light emission control signal (hereinafter, referred to as an "EM signal") in the organic light emitting diode display. The scan signal includes a scan pulse swinging between the gate-on voltage VGH and the gate-off voltage VGL. The EM signal may include an EM pulse swinging between the gate-on voltage VEH and the gate-off voltage VEL.

The scan pulse is synchronized with the data voltage to select pixels of a line to which data is to be written. The EM signal defines the emission time of the pixels.

The gate driver 120 may include a first gate driver 121 and a second gate driver 122. The first gate driver 121 outputs the scan pulse in response to a start pulse and a shift clock from the timing controller 130, and shifts the scan pulse according to the shift clock. The second gate driver 122 outputs the EM pulse in response to the start pulse and the shift clock from the timing controller 130, and sequentially shifts the EM pulse according to the shift clock.

The timing controller 130 receives digital video data DATA of an input image, and a timing signal synchronized therewith, from the host system. The timing signal may include a vertical synchronization signal Vsync, a horizontal synchronization signal Hsync, a clock CLK, a data enable signal DE, and the like. Because a vertical period and a horizontal period can be known by counting the data enable signal DE, the vertical synchronization signal Vsync and the horizontal synchronization signal Hsync may be omitted. The data enable signal DE has a cycle of one horizontal period (1H).

The host system may be one of a television (TV) system, a tablet computer, a notebook computer, a navigation system, a personal computer (PC), a home theater system, a mobile device, a wearable device, and a vehicle system. The host system may scale an image signal from a video source to fit the resolution of the display panel 100 and transmit it to the timing controller 130 together with the timing signal.

The timing controller 130 multiplies an input frame frequency by i ('i' is a natural number) and controls the operation timing of the display panel driver with a frame frequency of the input frame frequency×i Hz. The input frame frequency is 60 Hz in the NTSC (National Television Standards Committee) scheme and 50 Hz in the PAL (Phase-Alternating Line) scheme. In order to lower the refresh rate of pixels in the low-speed driving mode, the timing controller 130 may lower the driving frequency of the display panel driver by lowering the frame frequency to a frequency between 1 Hz and 30 Hz.

Based on the timing signals Vsync, Hsync, and DE received from the host system, the timing controller 130 generates a data timing control signal for controlling the operation timing of the data driver 110, MUX signals MUX1 and MUX2 for controlling the operation timing of the de-multiplexer array 112, and a gate timing control signal for controlling the operation timing of the gate driver 120. By controlling the operation timing of the display panel driver, the timing controller 130 synchronizes the data driver 110, the de-multiplexer array 112, the touch sensor driver, and the gate driver 120.

The voltage level of the gate timing control signal outputted from the timing controller 130 may be converted into the gate-on voltages VGH and VEH and the gate-off voltages VGL and VEL through a level shifter (not shown) and then supplied to the gate driver 120. The level shifter converts a low level voltage of the gate timing control signal into the gate-off voltages VGL and VEL and converts a high level voltage of the gate timing control signal into the gate-on voltages VGH and VEH. The gate timing control signal includes the start pulse and the shift clock.

Due to device characteristic deviations and process deviations caused in the manufacturing process of the display panel 100, there may be differences in electrical characteristics of the driving element among pixels, and such differences may increase as driving time of the pixels elapses. In order to compensate for differences in electrical characteristics of the driving element among pixels, an internal compensation technique or an external compensation technique may be applied to the organic light emitting diode display. The internal compensation technique samples a threshold voltage of the driving element for each sub-pixel by using an internal compensation circuit implemented in each pixel circuit and compensates the gate-source voltage Vgs of the driving element by the threshold voltage. The external compensation technique senses in real time a current or voltage of the driving element that varies according to electrical characteristics of the driving element by using an external compensation circuit. The external compensation technique compensates for the deviation (or variation) of the electrical characteristics of the driving element in each pixel in real time by modulating the pixel data (digital data) of the input image by the electrical characteristic deviation (or variation) of the driving element sensed for each pixel. Using the external compensation technique and/or the internal compensation technique, the display panel driver may drive the pixels. The pixel circuit may be implemented as a circuit to which the internal compensation circuit is applied, for example, the circuits shown in FIGS. 5 to 10.

Figure 2:
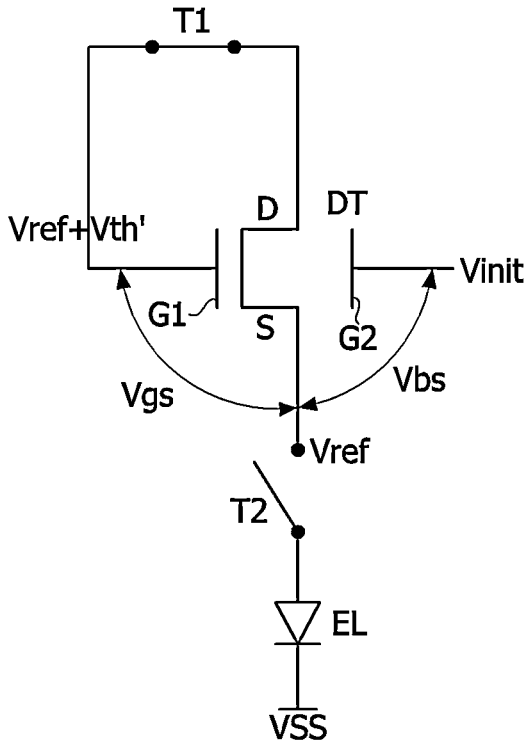
FIG. 2 is a circuit diagram illustrating a pixel circuit according to one embodiment of the present disclosure.

FIG. 2 is a circuit diagram illustrating a pixel circuit according to one embodiment of the present disclosure.

Referring to FIG. 2, the pixel circuit includes a light emitting element EL, a driving element DT for driving the light emitting element EL, a first switch element T1 connected between a first gate electrode G1 and a first electrode D of the driving element DT, and a second switch element T2 connected between a second electrode S of the driving element DT and the light emitting element EL. The driving element DT and the switch elements T1 and T2 may be implemented as n-channel oxide TFTs.

The light emitting element EL may be implemented as an OLED. The OLED includes an organic compound layer formed between an anode electrode and a cathode electrode. The organic compound layer may include, but is not limited to, a hole injection layer (HIL), a hole transport layer (HTL), an emission layer (EML), an electron transport layer (ETL), and an electron injection layer (EIL). When a voltage is applied to the anode and cathode electrodes of the OLED, holes passing through the hole transport layer (HTL) and electrons passing through the electron transport layer (ETL) are moved to the emitting layer (EML) to form exciton, and thus visible light is emitted from the emitting layer (EML). The OLED used as the light emitting element EL may have a tandem structure in which a plurality of emitting layers are stacked. The OLED of the tandem structure can improve the luminance and lifespan of pixels.

The driving element DT may be a MOSFET with a double gate structure including a first gate electrode G1 and a second gate electrode G2. The second gate electrode G2 may be a body electrode. The first gate electrode G1 and the second gate electrode G2 may overlap each other with a semiconductor active pattern therebetween. A predetermined voltage, for example, an initialization voltage Vinit to be described later, may be applied to the second gate electrode G2.

A voltage Vbs between the second gate electrode G2 of the driving element DT and the second electrode S of the driving element DT may shift the threshold voltage of the driving element DT to a desired voltage. The first electrode may be a drain electrode, and the second electrode may be a source electrode. Hereinafter, the voltage between the second gate electrode G2 of the driving element DT and the second electrode S of the driving element DT is abbreviated as "Vbs".

The first switch element T1 includes a first electrode connected to the first electrode D of the driving element DT, a second electrode connected to the first gate electrode G1 of the driving element DT, and a gate electrode to which a scan pulse is applied. The first switch element T1 is turned on in response to the gate-on voltage VGH of the scan pulse and is turned off according to the gate-off voltage VGL. When the first switch element T1 is turned on, the driving element DT operates as a diode because the first gate electrode G1 and the first electrode D are connected. When the first switch element T1 is turned off, the first gate electrode G1 and the first electrode D of the driving element DT are separated.

The second switch element T2 includes a first electrode connected to the second electrode S of the driving element DT, a second electrode connected to the anode electrode of the light emitting element EL, and a gate electrode to which an EM pulse is applied. The second switch element T2 is turned on in response to the gate-on voltage VEH of the EM pulse and is turned off according to the gate-off voltage VEL. When the second switch element T2 is turned on, a current path is formed between the driving element DT and the light emitting element EL to supply current to the light emitting element EL. When the second switch element T2 is turned off, the current path between the driving element DT and the light emitting element EL is cut off.

Figure 3:
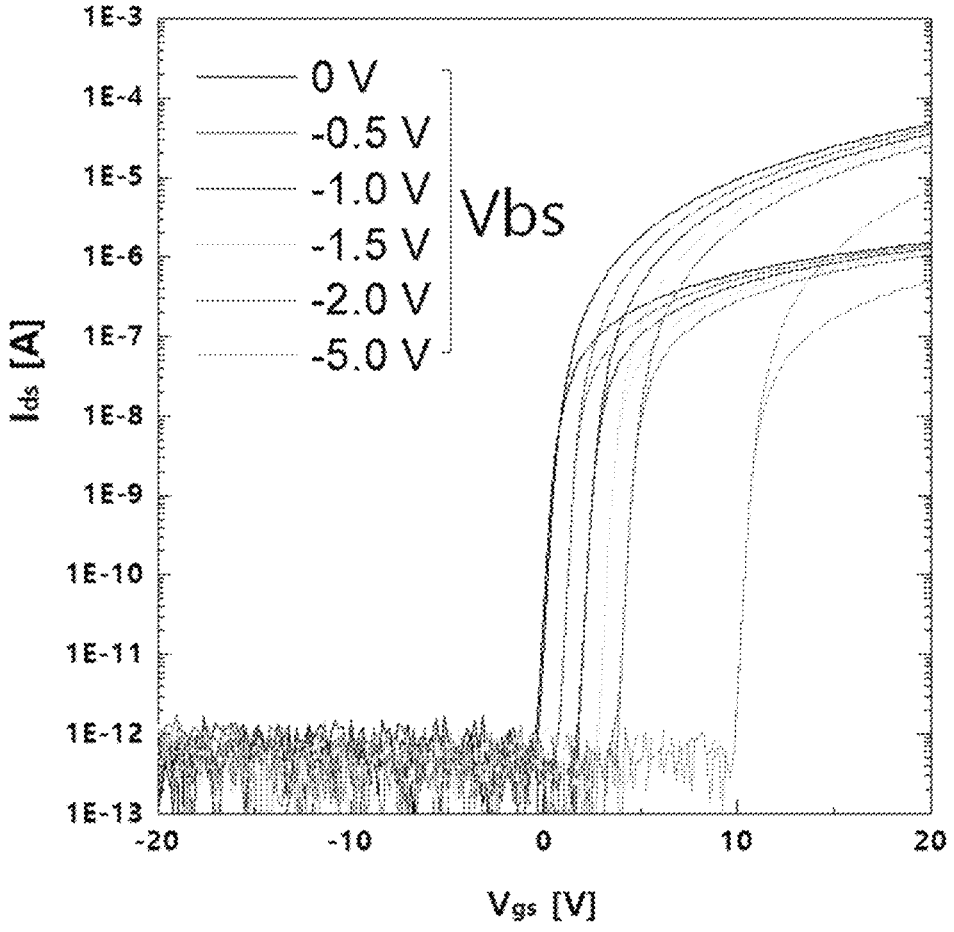
FIG. 3 is a diagram illustrating a simulation result for verifying an effect of shifting a threshold voltage of a driving element by Vbs shown in FIG. 2.

In FIG. 3, the horizontal axis represents a gate-source voltage Vgs[V] of the driving element DT, and the vertical axis represents a drain-source current Ids[A] of the driving element DT. When sensing the threshold voltage of the driving element DT, Vbs may shift the threshold voltage of the driving element DT to within a range capable of sensing as shown in FIG. 3. Therefore, it is possible to accurately sense the threshold voltage of the driving element DT even if the shift of the threshold voltage of the driving element DT exceeds the range capable of sensing. For example, if the threshold voltage of the driving element DT is shifted to a voltage of 0V or less, the threshold voltage of the driving element DT cannot be sensed. However, using Vbs, the threshold voltage of the driving element DT can be shifted to a positive voltage higher than 0V. The degree of threshold voltage shift of the driving element DT depends on Vbs, a parasitic capacitance (Cgi in FIG. 4) connected to the first gate electrode G1, and a parasitic capacitance (Cbuf in FIG. 4) connected to the second gate electrode G2, so that it is possible to shift the threshold voltage of the driving element to a desired voltage.

When the reference voltage Vref is applied to the first gate electrode G1 of the driving element DT and the initialization voltage Vinit is applied to the second gate electrode G2, the voltage of the first gate electrode G1 may be Vref+Vth' in FIG. 2. Vref is a reference voltage, and Vth' is a threshold voltage of the driving element DT shifted by Vbs. In this case, if Vref>Vinit, the threshold voltage of the driving element DT may be shifted to a positive voltage.

Figure 4:
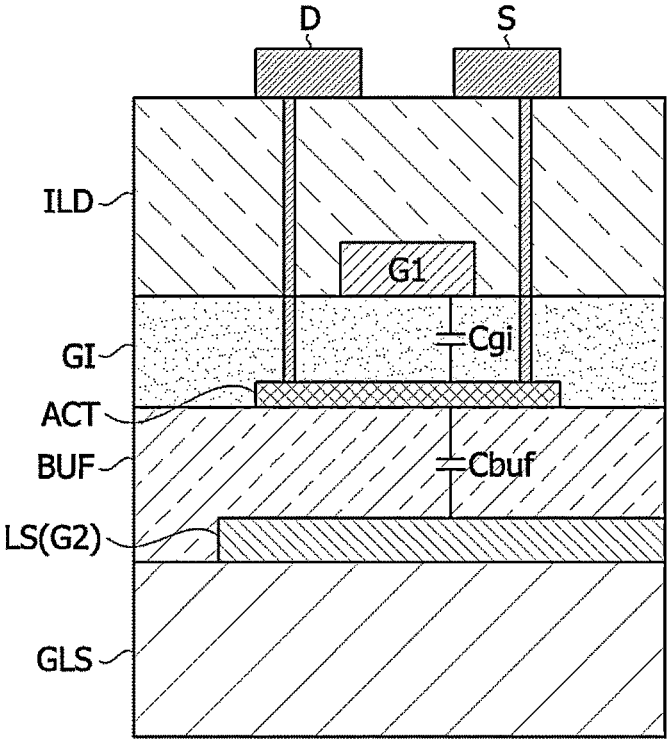
FIG. 4 is a cross-sectional diagram schematically illustrating a cross-sectional structure of a driving element.

FIG. 4 is a cross-sectional diagram schematically illustrating a cross-sectional structure of the driving element DT in the display panel 100.

Referring to FIG. 4, a first metal pattern may be formed on a substrate GLS of the display panel 100. The first metal pattern may include a light shield layer LS integrated with the second gate electrode G2 of the driving element DT. The light shield layer LS blocks the light irradiated to a semiconductor active pattern ACT of the driving element DT to prevent a threshold voltage shift of the driving element DT, and is applied with the initialization voltage Vinit.

A first insulating layer BUF may be formed on the substrate GLS to cover the first metal pattern. A semiconductor layer may be formed on the first insulating layer BUF. The semiconductor layer includes the semiconductor active pattern ACT of the driving element DT.

A second insulating layer GI may be formed on the first insulating layer BUF to cover the semiconductor pattern. A second metal pattern may be formed on the second insulating layer GI. The second metal pattern may include the first gate electrode G1 of the driving element DT.

A third insulating layer ILD may be formed on the second insulating layer GI to cover the second metal pattern. A third metal pattern may be formed on the third insulating layer ILD. The third metal pattern may include the first and second electrodes D and S of the driving element DT.

In FIG. 4, "Cgi" is a parasitic capacitance formed between the first gate electrode G1 and the semiconductor active pattern ACT in the driving element DT, and "Cbuf" is a parasitic capacitance formed between the second gate electrode G2 and the semiconductor active pattern ACT in the driving element DT.

Figure 6:
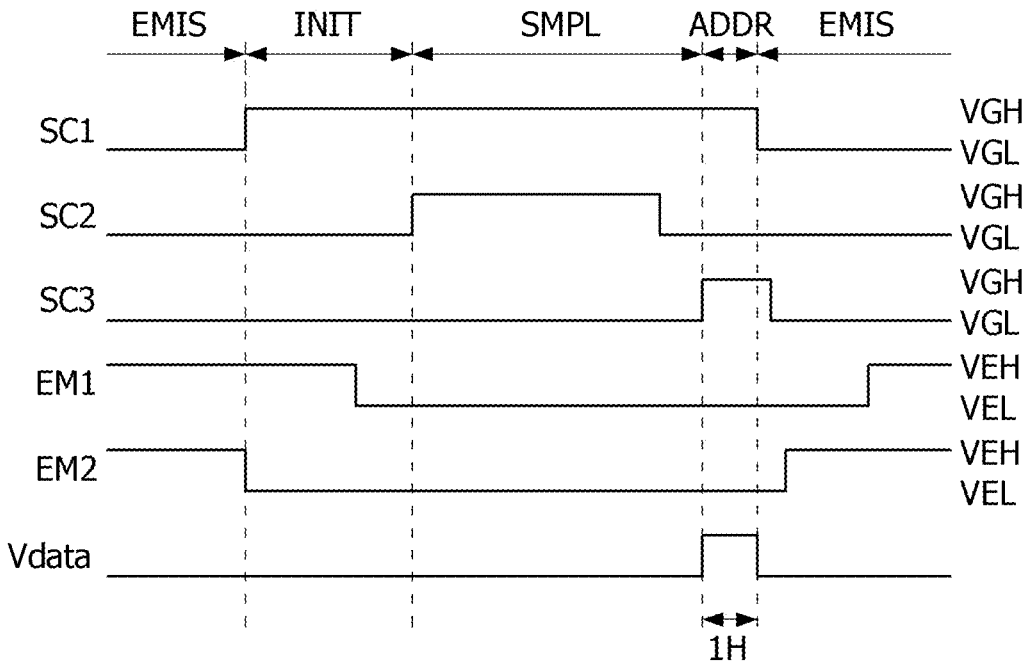
FIG. 6 is a waveform diagram illustrating a method for driving the pixel circuit shown in FIG. 5.

FIG. 5 is a circuit diagram illustrating a pixel circuit according to another embodiment of the present disclosure. The pixel circuit illustrated in FIG. 5 includes an internal compensation circuit that samples the threshold voltage of the driving element DT and compensate for a variation in the threshold voltage of the driving element DT. FIG. 6 is a waveform diagram illustrating a method of driving the pixel circuit shown in FIG. 5.

Referring to FIGS. 5 and 6, the pixel circuit includes a light emitting element EL, a driving element DT, first and second capacitors C1 and C2, and first to seventh switch elements T1 to T7. The driving element DT and the switch elements T1 to T7 may be implemented as n-channel oxide TFTs.

In this pixel circuit, a direct current voltage such as a pixel driving voltage VDD, a low-potential power supply voltage VSS, a reference voltage Vref, and an initialization voltage Vinit, a data voltage Vdata that varies according to a gray scale of pixel data, scan pulses SC1, SC2, and SC3, and EM pulses EM1 and EM2 are supplied. Voltages of the scan pulses SC1, SC2, and SC3 and the EM pulses EM1 and EM2 swing between the gate-on voltages VGH and VEH and the gate-off voltages VGL and VEL.

A voltage relationship commonly applied to the pixels may be set as VDD>Vref>Vinit>VSS. The data voltage Vdata may be generated as a gamma compensation voltage selected according to the gray scale of the pixel data from the data driver 110 in a voltage range lower than the pixel driving voltage VDD and higher than the low-potential power supply voltage VSS. The gate-on voltages VGH and VEH may be set to be higher than the pixel driving voltage VDD. The gate-off voltages VGL and VEL may be set to be lower than the low-potential power supply voltage VSS.

The scan pulses SC1, SC2, and SC3 may include a first scan pulse SC1 applied to a first gate line GL1, a second scan pulse SC2 applied to a second gate line GL2, and a third scan pulse SC3 applied to a third gate line GL3. The EM pulses EM1 and EM2 may include a first EM pulse EM1 applied to a fourth gate line GL4 and a second EM pulse EM2 applied to a fifth gate line GL5.

The driving period of the pixel circuit may be divided into an initialization step INIT in which the pixel circuit is initialized, a sampling step SMPL in which the threshold voltage Vth of the driving element DT is sampled, an addressing step ADDR in which the data voltage Vdata is charged and pixel data is written, and a light emission step EMIS in which the light emitting element EL emits light with a brightness corresponding to the gray scale of the pixel data.

The voltage of the first scan pulse SC1 may be the gate-on voltage VGH in the initialization step INIT, the sampling step SMPL, and the addressing step ADDR. The voltage of the first scan pulse SC1 may be the gate-off voltage VGL in the light emission step EMIS. The second scan pulse SC2 may rise later than the first scan pulse SC1 and fall prior to the first scan pulse SC1. The voltage of the second scan pulse SC2 may be the gate-on voltage VGH in the sampling step SMPL. The voltage of the second scan pulse SC2 may be the gate-off voltage VGL in the initialization step INIT, the addressing step ADDR, and the light emission step EMIS. The third scan pulse SC3 is synchronized with the data voltage Vdata. The voltage of the third scan pulse SC3 may be the gate-on voltage VGH in the addressing step ADDR. The voltage of the third scan pulse SC3 may be the gate-off voltage VGL in the initialization step INIT, the sampling step SMPL, and the light emission step EMIS.

The first EM pulse EM1 may be generated as the gate-on voltage VEH during at least a partial period of the initialization step INIT and at least a partial period of the light emission step EMIS. The voltage of the first EM pulse EM1 may be the gate-off voltage VEL in the sampling step INIT and the addressing step ADDR. The second EM pulse EM2 may be generated as the gate-on voltage VEH during at least a partial period of the light emission step EMIS. The voltage of the second EM pulse EM2 may be the gate-off voltage VEL in the initialization step INIT, the sampling step INIT, and the addressing step ADDR. The second EM pulse EM2 may rise to the gate-on voltage VGH prior to the first EM pulse EM1 at the beginning of the light emission step EMIS or rise to the gate-on voltage VGH simultaneously with the first EM pulse EM1.

The data voltage Vdata of the pixel data is supplied to the pixel circuit through a data line DL in synchronization with the third scan pulse SC3, in the addressing step ADDR.

The light emitting element EL may be implemented as an OLED. The anode electrode of the light emitting element EL may be connected to a fourth node n4, and the low-potential power supply voltage VSS may be applied to the cathode electrode of the light emitting element EL.

A first capacitor C1 is connected between a second node n2 and the fourth node n4. The first capacitor C1 is a storage capacitor that maintains the gate-source voltage Vgs of the driving element DT in the light emission step EMIS. A second capacitor C2 is connected between a first node n1 and a fifth node n5. The second capacitor C2 transfers the reference voltage Vref and the data voltage Vdata to the first node n1.

The driving element DT may be a MOSFET having a double gate structure. The driving element DT includes a first gate electrode connected to the second node n2, a second gate electrode connected to the fourth node n4, a first electrode connected to the first node n1, and a second electrode connected to the third node n3. As shown in FIG. 4, the first and second gate electrodes of the driving element DT may overlap each other with the semiconductor active pattern therebetween.

The first switch element T1 includes a first electrode connected to the first node n1, a second electrode connected to the second node n2, and a gate electrode to which the first scan pulse SC1 is applied. The first switch element T1 is turned on in response to the gate-on voltage VGH of the first scan pulse SC1 and connects the first node n1 and the second node n2, in the initialization step INIT, the sampling step SMPL, and the addressing step ADDR. When the first switch element T1 is turned on, the driving element DT operates as a diode because the first gate electrode G1 and the first electrode are connected.

The second switch element T2 includes a first electrode connected to the third node n3, a second electrode connected to the fourth node n4, and a gate electrode to which the second EM pulse EM2 is applied. The second switch element T2 is turned on in response to the gate-on voltage VEH of the second EM pulse EM2 and forms a current path between the driving element DT and the light emitting element EL, during at least a partial period of the light emission step EMIS. In the initialization step INIT, the sampling step SMPL, and the addressing step ADDR, in which the second switch element T2 is in an off state, the current path between the driving element DT and the light emitting element EL is cut off, and thus the light emitting element EL does not emit light.

The third switch element T3 includes a first electrode connected to the second power line INL to which the initialization voltage Vinit is applied, a second electrode connected to the fourth node n4, and a gate electrode to which the first scan pulse SC1 is applied. The third switch element T3 is turned on in response to the gate-on voltage VGH of the first scan pulse SC1 and supplies the initialization voltage Vinit to the fourth node n4, in the initialization step INIT, the sampling step SMPL, and the addressing step ADDR. In the light emission step EMIS in which the third switch element T3 is turned off, a current path between the second power line INL and the fourth node n4 is cut off.

The fourth switch element T4 includes a first electrode connected to the fifth node n5, a second electrode connected to the data line DL to which the data voltage Vdata of pixel data is applied, and a gate electrode to which the third scan pulse SC3 is applied. The fourth switch element T4 is turned on in response to the gate-on voltage VGH of the third scan pulse SC3 and supplies the data voltage Vdata to the fifth node n5, in the addressing step ADDR. In the initialization step INIT, the sampling step SMPL, and the light emission step EMIS, in which the fourth switch element T4 is turned off, a current path between the data line DL and the fifth node n5 is cut off.

The fifth switch element T5 includes a first electrode connected to the first power line VDDL to which the pixel driving voltage VDD is applied, a second electrode connected to the first node n1, and a gate electrode to which the first EM pulse EM1 is applied. The fifth switch element T5 is turned on in response to the gate-on voltage VEH of the first EM pulse EM1 and supplies the pixel driving voltage VDD to the first node n1, in the initialization step INIT and the light emission step EMIS. In the sampling step SMPL and the addressing step ADDR, in which the fifth switch element T5 is turned off, a current path between the first power line VDDL and the first node n1 is cut off.

The sixth switch element T6 includes a first electrode connected to the third power line REFL to which the reference voltage Vref is applied, a second electrode connected to the third node n3, and a gate electrode to which the second scan pulse SC2 is applied. The sixth switch element T6 is turned on in response to the gate-on voltage VGH of the second scan pulse SC2 and supplies the reference voltage Vref to the third node n3, in the sampling step SMPL. In the initialization step INIT, the addressing step ADDR, and the light emission step EMIS, in which the sixth switch element T6 is turned off, a current path between the third power line REFL and the third node n3 is cut off.

The seventh switch element T7 includes a first electrode connected to the fifth node n5, a second electrode connected to the third node n3, and a gate electrode to which the second scan pulse SC2 is applied. The seventh switch element T7 is turned on in response to the gate-on voltage VGH of the second scan pulse SC2 and connects the fifth node n5 to the third node n3, in the sampling step SMPL. When the seventh switch element T7 is turned on, the reference voltage Vref is applied to the fifth node n5, and the reference voltage Vref is applied to the first node n1 through the second capacitor C2. In the initialization step INIT, the addressing step ADDR, and the light emission step EMIS, in which the seventh switch element T7 is turned off, a current path between the third node n3 and the fifth node n5 is cut off.

The threshold voltage Vth of the driving element DT may be sampled by applying the data voltage Vdata to the gate electrode of the driving element DT. In this case, because the threshold voltage sampling and data addressing of the driving element DT are simultaneously performed, the sampling time is limited to one horizontal period 1H. On the other hand, in the present disclosure, the threshold voltage Vth' of the driving element DT is sampled by applying the reference voltage Vref to the third node n3 in the sampling step SMPL and is stored in the capacitor C1, and the data voltage Vdata is applied to the first node n1 in the addressing step ADDR, so that the sampling step SMPL and the addressing step ADDR can be separated. As a result, according to the present disclosure, the threshold voltage Vth of the driving element DT can be accurately sensed by ensuring a sufficiently long time, for example, two or more horizontal periods, of the sampling step SMPL, and thereby the shift of the threshold voltage Vth' can be compensated.

During the light emission step EMIS, the initialization voltage Vinit applied to the second gate electrode of the driving element DT is substantially the same as the source voltage of the driving element DT. For this reason, there is no shift in the threshold voltage of the driving element DT due to the voltage of the second gate electrode of the driving element DT in the light emission step EMIS.

Figure 7:
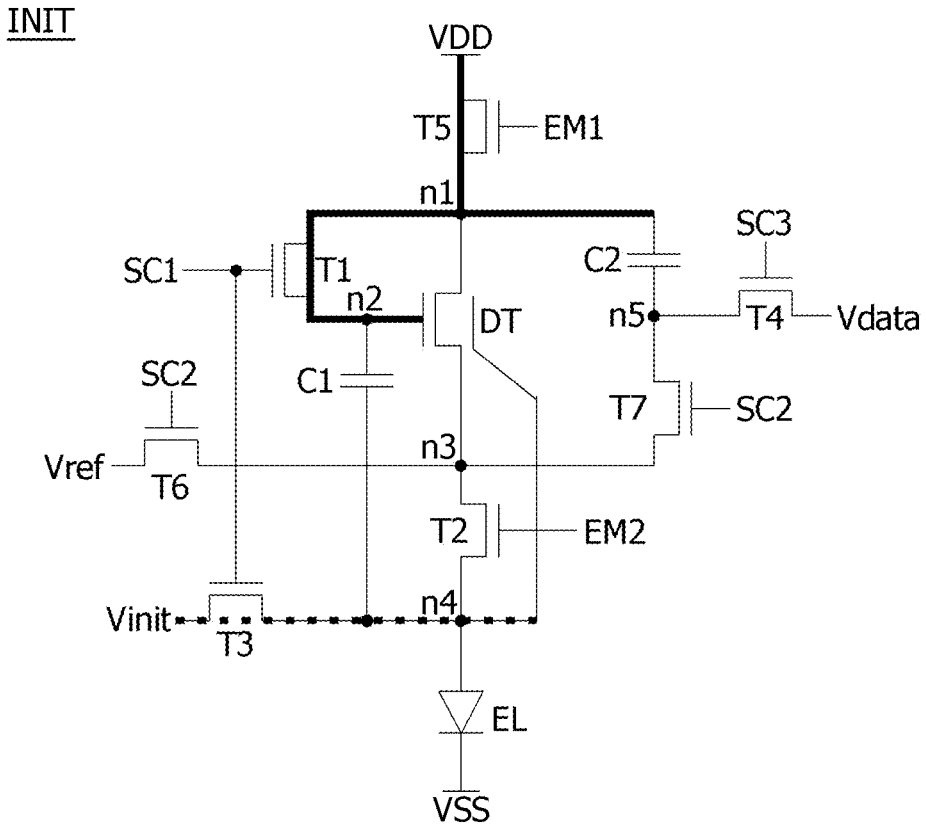
FIG. 7 is a circuit diagram illustrating an initialization step of the pixel circuit shown in FIG. 5.
Figure 8:
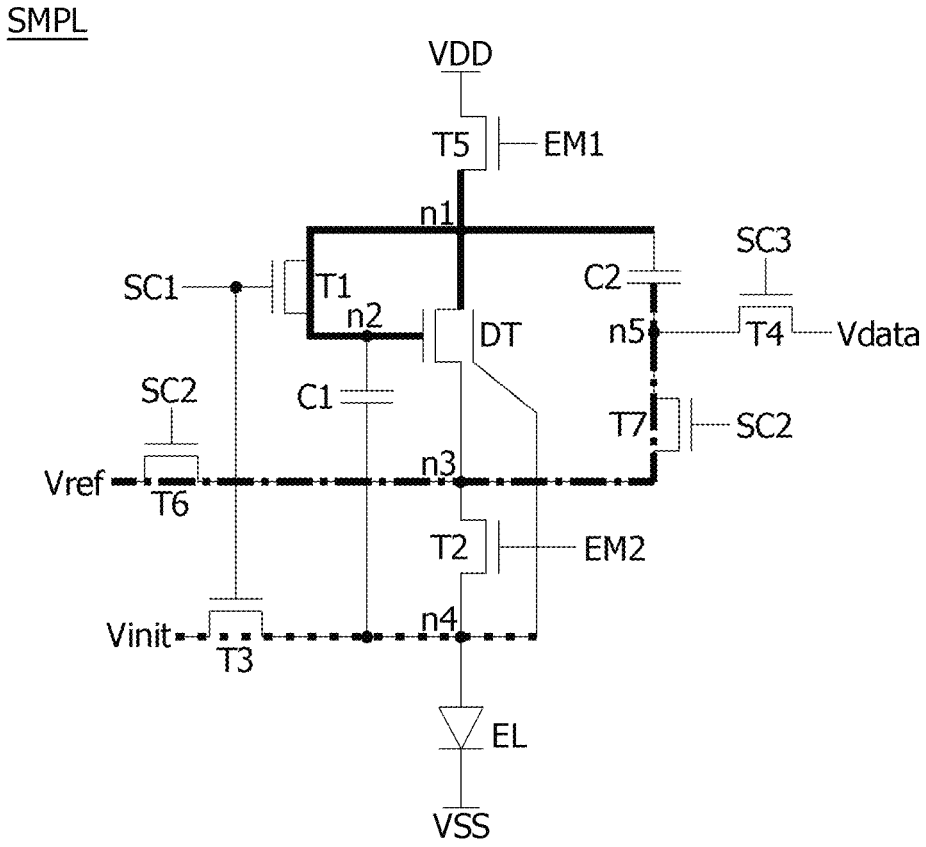
FIG. 8 is a circuit diagram illustrating a sampling step of the pixel circuit shown in FIG. 5.

As seen from FIGS. 7 and 8, in the initialization step INIT, the initialization voltage Vinit is applied to the first gate of the driving element DT through the anode electrode of the light emitting element EL and the first capacitor C1, and the pixel driving voltage VDD higher than the initialization voltage Vinit is applied to the first electrode of the driving element DT. In the sampling step SMPL, the reference voltage Vref lower than the pixel driving voltage VDD is applied to the second electrode of the driving element DT and applied to the first electrode of the driving element DT through the second capacitor C2.

The data voltage Vdata of the pixel data is applied to the first electrode of the driving element DT through the second capacitor C2 in the addressing step ADDR. In the light emission step EMIS, a current path is formed between the power line to which the pixel driving voltage VDD is applied and the light emitting element EL, and also the initialization voltage Vinit and the reference voltage Vref applied to the driving element DT and the light emitting element EL are cut off.

The initialization voltage Vinit is applied to the second gate electrode of the driving element in the initialization step INIT, the sampling step SMPL, and the addressing step ADDR. Due to the initialization voltage Vinit applied to the second gate electrode of the driving element DT in the initialization step INIT and the sampling step SMPL, the threshold voltage of the driving element DT can be shifted to a voltage higher than 0 V. The initialization voltage Vinit is set to a voltage higher than 0 V.

Hereinafter, a step-by-step driving method of the pixel circuit will be described in detail with reference to FIGS. 7 to 10.

FIG. 7 is a circuit diagram illustrating an initialization step INIT of the pixel circuit shown in FIG. 5.

Referring to FIG. 7, in the initialization step INIT, the first switch element T1 and the fifth switch element T5 are turned on, and thereby the first gate electrode and the first electrode of the driving element DT are connected as a diode connection. At this time, the voltage of the first node n1 is initialized to the pixel driving voltage VDD, the voltage of the third node n3 is initialized to the initialization voltage Vinit, and thereby the driving element DT is turned on. Vth' is the threshold voltage of the driving element DT shifted by the initialization voltage Vinit applied to the second gate electrode of the driving element DT. In the initialization step INIT, the third switch element T3 is also turned on. Therefore, the light emitting element EL is turned off because the initialization voltage Vinit lower than its threshold voltage is applied to the anode electrode. In the initialization step INIT, the second switch element T2, the sixth switch element T6, and the seventh switch element T7 are turned off.

FIG. 8 is a circuit diagram illustrating a sampling step SMPL of the pixel circuit shown in FIG. 5.

Referring to FIG. 8, in the sampling step SMPL, the first switch element T1, the third switch element T3, and the driving element DT maintain the ON state. In the sampling step SMPL, the sixth and seventh switch elements T6 and T7 are turned on and thereby the reference voltage Vref is applied to the third and fifth nodes n3 and n5. At this time, the voltage of the first node n1 is changed to Vref+Vth', and the fourth node n4 maintains the initialization voltage Vinit. In the sampling step SMPL, the threshold voltage Vth' of the driving element DT is sampled and stored in the first capacitor C1. In the sampling step SMPL, the second switch element T2 maintains the OFF state, and the fifth switch element T5 is turned off.

Figure 9:
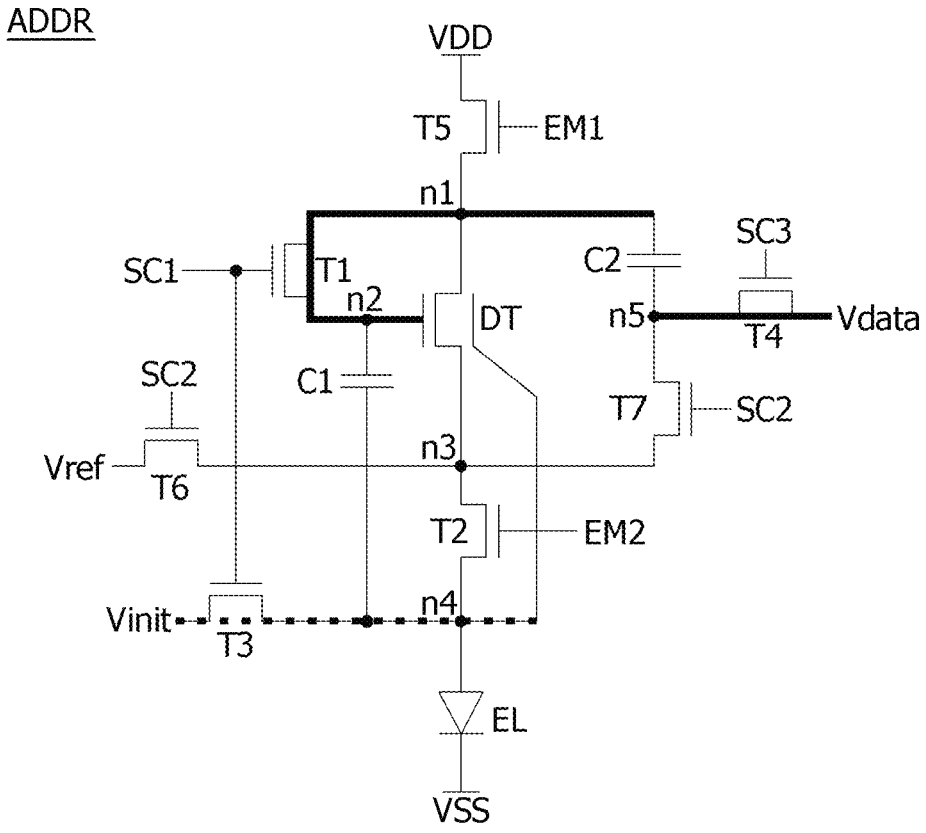
FIG. 9 is a circuit diagram illustrating an addressing step of the pixel circuit shown in FIG. 5.

FIG. 9 is a circuit diagram illustrating an addressing step ADDR of the pixel circuit shown in FIG. 5.

Referring to FIG. 9, in the addressing step ADDR, the first switch element T1, the third switch element T3, the fourth switch element T4, and the driving element DT maintain the ON state. In the addressing step ADDR, the voltage of the first node n1 is changed to Vref+Vth'+C'(Vdata+Vref), and the fourth node n4 maintains the initialization voltage Vinit. Here, C' is C2/(C1+C2). In the addressing step ADDR, the second and fifth switch elements T2 and T5 maintain the OFF state, and the sixth and seventh switch elements T6 and T7 are turned off.

Figure 10:
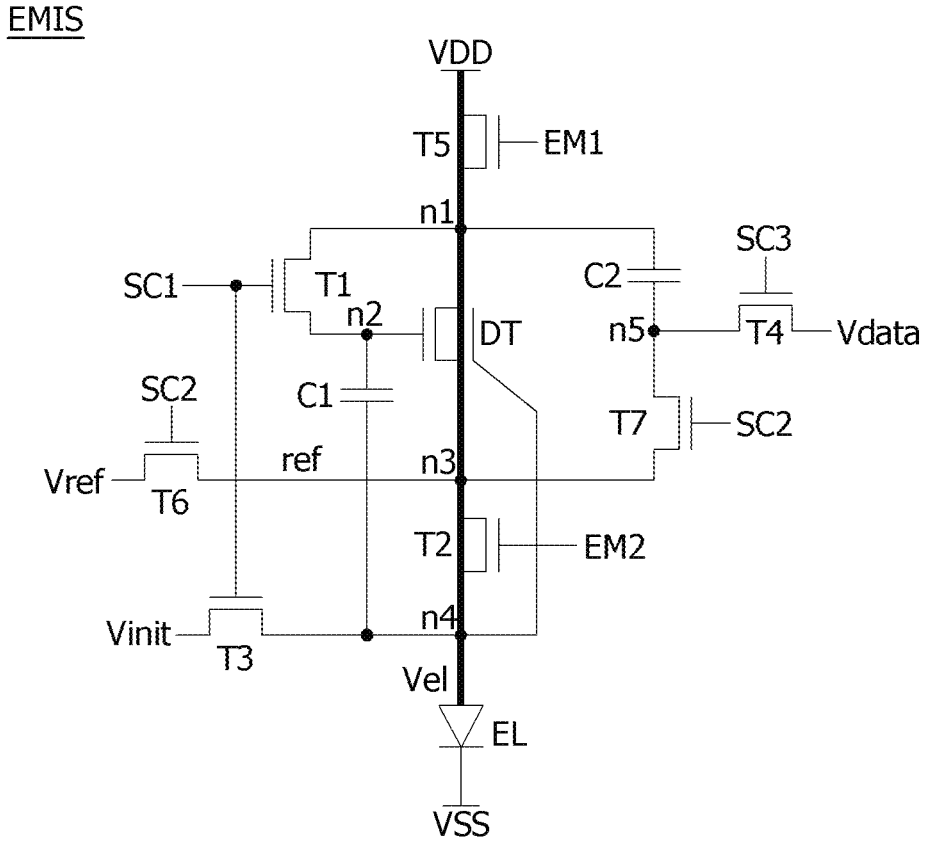
FIG. 10 is a circuit diagram illustrating a light emission step of the pixel circuit shown in FIG. 5.

FIG. 10 is a circuit diagram illustrating a light emission step EMIS of the pixel circuit shown in FIG. 5.

Referring to FIG. 10, in the light emission step EMIS, the second switch element T2 and the fifth switch element DT are turned on, and the first, third, and fourth switch elements T1, T3, and T4 are turned off. In the light emission step EMIS, the sixth and seventh switch elements T6 and T7 maintain the off state. At this time, current is supplied to the light emitting element EL according to the gate-source voltage Vgs of the driving element DT, so that the light emitting element EL can be turned on. In the light emission step EMIS, the voltage at the fourth node n4 is the anode voltage Vel of the light emitting element DT, and the voltage of the second node n2 applied to the first gate electrode of the driving element DT is Vref+Vth'+C'(Vdata−Vref)+Vel.

In the light emission step EMIS, current Ioled flowing through the light emitting element EL is $k[(Vref-Vinit)+C'(Vdata-Vref)+(Vth'-Vth)]^2$. Here, k is a constant value determined according to the mobility and parasitic capacitance of the driving element DT, and Vth is an initial threshold voltage when Vbs of the driving element DT is zero.

The objects to be achieved by the present disclosure, the means for achieving the objects, and effects of the present disclosure described above do not specify essential features of the claims, and thus, the scope of the claims is not limited to the disclosure of the present disclosure.

It will be apparent to those skilled in the art that various modifications and variations can be made in the pixel circuit, the method for driving a pixel circuit and the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A pixel circuit, comprising:

a driving transistor including a first electrode connected to a first node, a first gate electrode connected to a second node, a second electrode connected to a third node, and a second gate electrode to which an initialization voltage is applied;

an organic light emitting diode (OLED) including an anode electrode connected to a fourth node and a cathode electrode to which a cathode voltage is applied, the OLED being driven according to a current from the driving transistor;

a first switch transistor including a first electrode connected to the first node, a second electrode connected to the second node, and a gate electrode to which a first scan pulse is applied;

a second switch transistor connected between the third node and the fourth node, the second switch transistor including a first electrode connected to the third node, a second electrode connected to the fourth node, and a gate electrode to which a second EM pulse is applied;

a third switch transistor including a first electrode to which the initialization voltage is applied, a second electrode connected to the fourth node, and a gate electrode to which the first scan pulse is applied;

a fourth switch transistor including a first electrode connected to a fifth node, a second electrode to which a data voltage of pixel data is applied, and a gate electrode to which a third scan pulse is applied;

a fifth switch transistor including a first electrode to which a pixel driving voltage is applied, a second electrode connected to the first node, and a gate electrode to which a first EM pulse is applied;

a sixth switch transistor including a first electrode to which a reference voltage is applied, a second electrode connected to the third node, and a gate electrode to which a second scan pulse is applied; and a seventh switch transistor including a first electrode connected to the fifth node, a second electrode connected to the third node, and a gate electrode to which the second scan pulse is applied.

2. The pixel circuit of claim 1, wherein a threshold voltage of the driving transistor is shifted to a positive voltage higher than 0 V by a voltage between the second gate electrode and the second electrode.

3. The pixel circuit of claim 1, further comprising:

a first capacitor connected between the second node and the fourth node; and a second capacitor connected between the first node and the fifth node.

4. The pixel circuit of claim 1, wherein:

the driving transistor and the switch transistors include an n-channel oxide semiconductor, and each of the switch transistors is turned on in response to a gate-on voltage.

5. The pixel circuit of claim 1, wherein when the initialization voltage is applied to the second gate electrode of the driving transistor, a threshold voltage of the driving transistor is shifted to a positive voltage higher than 0 V.

6. The pixel circuit of claim 1, wherein:

when the pixel driving voltage is VDD, the reference voltage is Vref, the initialization voltage is Vinit, and the cathode voltage is VSS, the voltages are set as VDD>Vref>Vinit>VSS, the data voltage of the pixel data is lower than the pixel driving voltage and higher than the cathode voltage, and each of the scan pulses and the EM pulses swings between the gate-on voltage higher than the pixel driving voltage and a gate-off voltage lower than the cathode voltage.

7. The pixel circuit of claim 6, wherein the pixel circuit is driven in an initialization step, a sampling step after the initialization step, an addressing step in which the data voltage is applied after the sampling step, and a light emission step after the addressing step, the first scan pulse is generated as the gate-on voltage in the initialization step, the sampling step, and the addressing step, and is generated as the gate-off voltage in the light emission step, the second scan pulse is generated as the gate-on voltage in the sampling step, and is generated as the gate-off voltage in the initialization step, the addressing step, and the light emission step, the third scan pulse is generated as the gate-on voltage in the addressing step, and is generated as the gate-off voltage in the initialization step, the sampling step, and the light emission step, the first EM pulse is generated as the gate-on voltage in at least a partial period of the initialization step and at least a partial period of the light emission step, and is generated as the gate-off voltage in the sampling step and the addressing step, and the second EM pulse is generated as the gate-on voltage in at least a partial period of the light emission step, and is generated as the gate-off voltage in the initialization step, the sampling step, and the addressing step.

8. The pixel circuit of claim 1, wherein the first and second gate electrodes overlap each other with a semiconductor active pattern therebetween.

9. The pixel circuit of claim 1, wherein a voltage between the second gate electrode and the second electrode shifts a threshold voltage of the driving transistor to within a range capable of sensing.

10. The pixel circuit of claim 9, wherein the threshold voltage of the driving transistor is shifted to a positive voltage higher than 0V from a voltage of 0V or less.

11. A display device comprising:

a display panel in which a plurality of data lines, a plurality of gate lines intersected with the data lines, a first power line to which a pixel driving voltage is applied, a second power line to which an initialization voltage is applied, a third power line to which a reference voltage is applied, a fourth power line to which a cathode voltage is applied, and a plurality of pixel circuits connected to the data lines, the gate lines, and the power lines are disposed;

a data driver supplying a data voltage of pixel data to the data lines; and a gate driver supplying a gate signal to the gate lines, wherein each of the pixel circuits includes:

a driving transistor including a first electrode connected to a first node, a first gate electrode connected to a second node, a second electrode connected to a third node, and a second gate electrode to which an initialization voltage is applied;

an organic light emitting diode (OLED) including an anode electrode connected to a fourth node and a cathode electrode to which a cathode voltage is applied, the OLED being driven according to a current from the driving transistor;

a first switch transistor including a first electrode connected to the first node, a second electrode connected to the second node, and a gate electrode to which the first scan pulse is applied;

a second switch transistor including a first electrode connected to the third node, a second electrode connected to the fourth node, and a gate electrode to which a second EM pulse is applied;

a third switch transistor including a first electrode to which the initialization voltage is applied, a second electrode connected to the fourth node, and a gate electrode to which a first scan pulse is applied;

a fourth switch transistor including a first electrode connected to a fifth node, a second electrode to which the data voltage of the pixel data is applied, and a gate electrode to which a third scan pulse is applied;

a fifth switch transistor including a first electrode to which the pixel driving voltage is applied, a second electrode connected to the first node, and a gate electrode to which a first EM pulse is applied;

a sixth switch transistor including a first electrode to which the reference voltage is applied, a second electrode connected to the third node, and a gate electrode to which a second scan pulse is applied; and a seventh switch transistor including a first electrode connected to the fifth node, a second electrode connected to the third node, and a gate electrode to which the second scan pulse is applied.

12. The display device of claim 11, wherein each of the pixel circuits further includes:

a first capacitor connected between the second node and the fourth node; and a second capacitor connected between the first node and the fifth node.

13. The display device of claim 11, wherein when the initialization voltage is applied to the second gate electrode of the driving transistor, a threshold voltage of the driving transistor is shifted to a positive voltage higher than 0V.

14. The display device of claim 11, wherein:

at least one of the pixel circuits is driven in an initialization step, a sampling step after the initialization step, an addressing step in which the data voltage is applied after the sampling step, and a light emission step after the addressing step, the first scan pulse is generated as the gate-on voltage in the initialization step, the sampling step, and the addressing step, and is generated as the gate-off voltage in the light emission step, the second scan pulse is generated as the gate-on voltage in the sampling step, and is generated as the gate-off voltage in the initialization step, the addressing step, and the light emission step, the third scan pulse is generated as the gate-on voltage in the addressing step, and is generated as the gate-off voltage in the initialization step, the sampling step, and the light emission step, the first EM pulse is generated as the gate-on voltage in at least a partial period of the initialization step and at least a partial period of the light emission step, and is generated as the gate-off voltage in the sampling step and the addressing step, the second EM pulse is generated as the gate-on voltage in at least a partial period of the light emission step, and is generated as the gate-off voltage in the initialization step, the sampling step, and the addressing step, and each of the switch transistors is turned on in response to the gate-on voltage.

* * * * *